US006758155B1

(12) United States Patent
Nicholas

(10) Patent No.: US 6,758,155 B1
(45) Date of Patent: Jul. 6, 2004

(54) FENDER RETRIEVAL SYSTEM

(76) Inventor: Watson C. Nicholas, 32793 Lakeview Dr., Lake City, MN (US) 55041

( * ) Notice: Subject to any disclaimer, the term of this patent is extended or adjusted under 35 U.S.C. 154(b) by 0 days.

(21) Appl. No.: 10/163,926

(22) Filed: Jun. 5, 2002

(51) Int. Cl.[7] ..... B63B 59/02
(52) U.S. Cl. ..... 114/219; 114/364; 114/343
(58) Field of Search ..... 114/219, 220, 114/343, 364; 405/212, 213, 214, 215; 293/9, 10

(56) References Cited

U.S. PATENT DOCUMENTS

| | | | | | |
|---|---|---|---|---|---|
| 1,505,785 | A | * | 8/1924 | Jiengiel | 114/123 |
| 3,280,785 | A | * | 10/1966 | Mycroft | 114/344 |
| 3,373,713 | A | * | 3/1968 | Hindman et al. | 114/220 |
| 3,664,653 | A | * | 5/1972 | Walker | 267/139 |
| 3,718,357 | A | * | 2/1973 | Hertzell | 293/9 |
| 3,822,662 | A | * | 7/1974 | Morita et al. | 114/123 |
| 4,280,435 | A | | 7/1981 | Loomis | |
| 4,533,119 | A | * | 8/1985 | Liverance et al. | 254/344 |
| 4,548,540 | A | * | 10/1985 | Renfro | 414/463 |
| 4,697,537 | A | * | 10/1987 | Smith | 114/230.23 |
| 4,817,552 | A | * | 4/1989 | Poldervaart | 114/230.27 |
| 4,846,090 | A | * | 7/1989 | Palmquist | 114/230.23 |
| 5,522,582 | A | * | 6/1996 | Dilks | 254/323 |
| 5,676,083 | A | * | 10/1997 | Korsgaard | 114/230.1 |
| 5,716,166 | A | * | 2/1998 | Phillips et al. | 405/211 |
| 5,819,679 | A | * | 10/1998 | Bonate et al. | 114/230.23 |
| 6,332,421 | B1 | | 12/2001 | Leonard et al. | |

FOREIGN PATENT DOCUMENTS

| | | | | | |
|---|---|---|---|---|---|
| GB | 2091678 | A | * | 8/1982 | B66C/13/10 |
| JP | 54083293 | A | * | 7/1979 | E02B/3/22 |
| JP | 56079074 | A | * | 6/1981 | B63B/1/12 |
| JP | 58191687 | A | * | 11/1983 | B63B/59/02 |
| JP | 05039085 | A | * | 2/1993 | B63B/59/02 |
| JP | 2001063685 | A | * | 3/2001 | B63B/59/02 |

* cited by examiner

*Primary Examiner*—Russell D. Stormer
*Assistant Examiner*—Ajay Vasudeva
(74) *Attorney, Agent, or Firm*—Nikolai & Mersereau, P.A.

(57) ABSTRACT

A boat fender deployment device having a motor for deploying a fender along side of a boat at a desired height for engaging a dock or other object by operation of a motor and for retracting the fender into a housing for storage when not in use. The housings may be attached to the boat or internally molded into the hull of the boat. The fender deployment is controlled by a switch for supplying power to drive a motor in the forward or reverse directions for deployment and positioning of fenders without the aid of crewmembers. A number of fenders attached to the boat, each individually controlled, provide the captain with a safe and reliable means for deploying and retracting fenders for the safe operation of a boat. The fenders deployed to the proper height protect a boat from damage when alongside a dock or other object.

7 Claims, 3 Drawing Sheets

FENDER RETRIEVAL SYSTEM

BACKGROUND OF THE INVENTION

1. Field of the Invention

This invention relates to boat fenders and more particularly to remotely raising and lowering the boat fenders on a boat.

2. Description of the Related Art

When a boat is adjacent a dock, lock, another boat or a wall it is essential that a fender be deployed between the boat and the other object such that the boat hull does not come in direct contact with the object. This is particularly important with fiberglass-hulled boats, which may crack if enough force is applied during contact. For example the force of waves, or wind, or currents may repeatedly force a boat hull in contact with a foreign object such as a wood or concrete dock damaging the boat. For aluminum or other metal hulls dents may occur if fenders are not deployed to protect the boat form the adjacent object.

It is frequently a difficult and dangerous job to deploy the fenders. For example, on a small craft a sailor may have to go to the front of the boat, while in rough waters in bad weather with a pitching slippery deck while walking very narrow ledges or side decks between the side of the vessel and the cabin. If a sailor were to fall overboard it could be fatal.

Further is the craft only has one person on board it poses a problem to steer the boat and run up to the front of the boat to deploy the fenders at the same time. Usually the boat must be stopped and the fenders deployed and then the boat started again which may be an operational problem in some situations.

The fenders must be secured on the boat against flopping around such that they are ready to deploy and the rope holding it in place is not tangled.

The fenders must be deployed to the correct depth for the type of object the boat is to be protected from such that each object needs a fender at a different height along the side of the boat.

The fenders need to be tied off to secure the fenders in the desired position.

SUMMARY OF THE INVENTION

A housing for containing a fender and a motor with a line wound around a rotating spool or pulley such that the fender can be lowered from the housing or drawn up into the housing by a switch at a remote location operating the motor. The housing secures the fender in position while not in use and maintains it in a ready to deploy position. The housing can be attached to the boat on the deck or a railing or alternatively be built into the side of the boat. A lip on the housing can help guide the fender into the housing when it is being retracted.

A two way motor raises or lowers the fender to the desired position to protect the boat by operating a switch at a control panel near the other controls for the boat.

The line attached the fender can be tied off on a cleat to keep the fender in place and protect the motor from excessive tugging as the fender is held between the boat and an object while force is applied to the line.

OBJECTS OF THE INVENTION

It is an object of the invention to deploy a boat fender to the proper height by remote control.

It is an object of the invention to increase boat safety.

It is an object of the invention to store fenders in a housing in the position for deployment.

It is an object of the invention to automatically raise and store deployed boat fenders.

It is an object of the invention to allow a one-man crew to deploy the fenders remotely while still controlling the boat.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
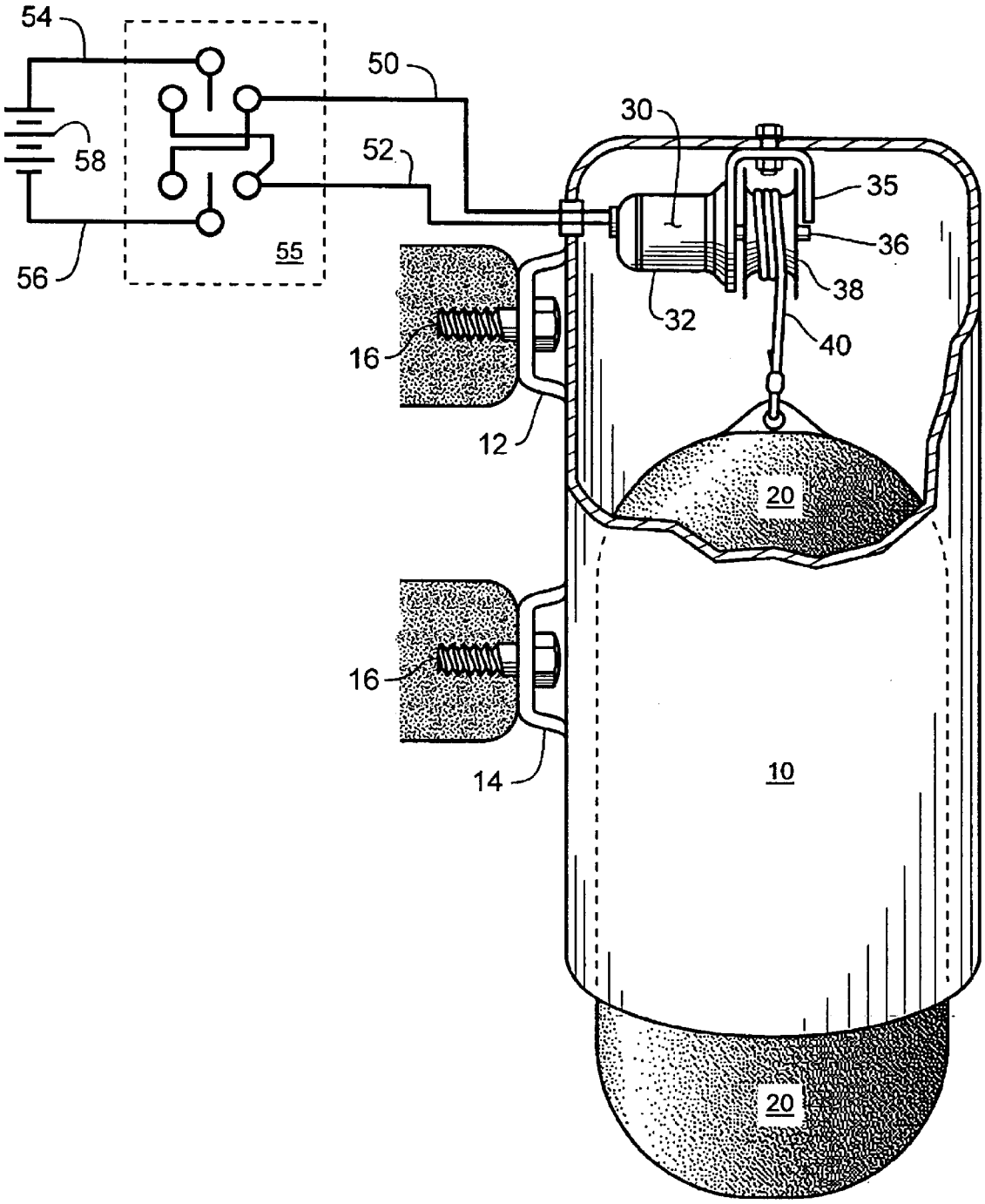
FIG. 1 is a cross sectional view of the fender retrieval system.

The fender retrieval system comprises a fender housing 10 having a motor 30 therein. The motor 30 rotates a shaft 36 having a spool or pulley 38 attached for winding up or unwinding a line 40 attached to a fender 20 for adjusting position of the fender 20 relative to the side of a boat 70. The motor 30 maybe in housing 32 to protect it against water, dirt or other foreign objects. The motor 30 may have wires 50, 52 connected to it to a switch 55 in the cabin or control center from which the Captain operates the boat. A power source 58, such as a battery, is connected by wires 54 and 56 to the switch 55 for providing power the motor 30. The switch 55 is engaged when the fender is to be deployed or retrieved. The switch 55 operates the motor 30 in either a forward or a reverse direction to raise or lower the fender 20. When coming along side a dock, lock, or other object the fender 20 is lowered to the height for intercepting the object such that the fender 20 blocks direct contact of the hull of the boat 70 with the object. When the boat 70 leaves the vicinity of the dock, lock, or other object, the fender 20 is raised such that it is again stored inside of the housing 10 where it is secured and out of the way such that the deck is not clutter the fenders 10 will not be hanging over the side of the boat 70. Thus the fenders will not be swinging about banging into the hull or riding partly in the water and will be ready for redeployment when needed.

As shown in FIG. 1 the fender housing 10 is upright and the motor 30 is inside a protective motor housing 32 mounted inside of the fender housing 10. In this embodiment a spool 38 has a line 40 wrapped around and connected to the fender 10 such that the motor 30 can raise or lower the fender 20 in and out of the fender housing 10. When the boat 70 is approaching a dock, a lock, a sea wall or other object the fenders can be deployed to the height needed to intercept the dock, lock or sea wall from coming into contact with the hull of the boat 70. The bolts 16 from upper bracket 12 and lower bracket 14 are used to attach the housing 10 to the side of the boat or railings adjacent the side of the boat. Although brackets and bolts are shown any means of attaching the housing to the boat 70 is acceptable.

Figure 2:
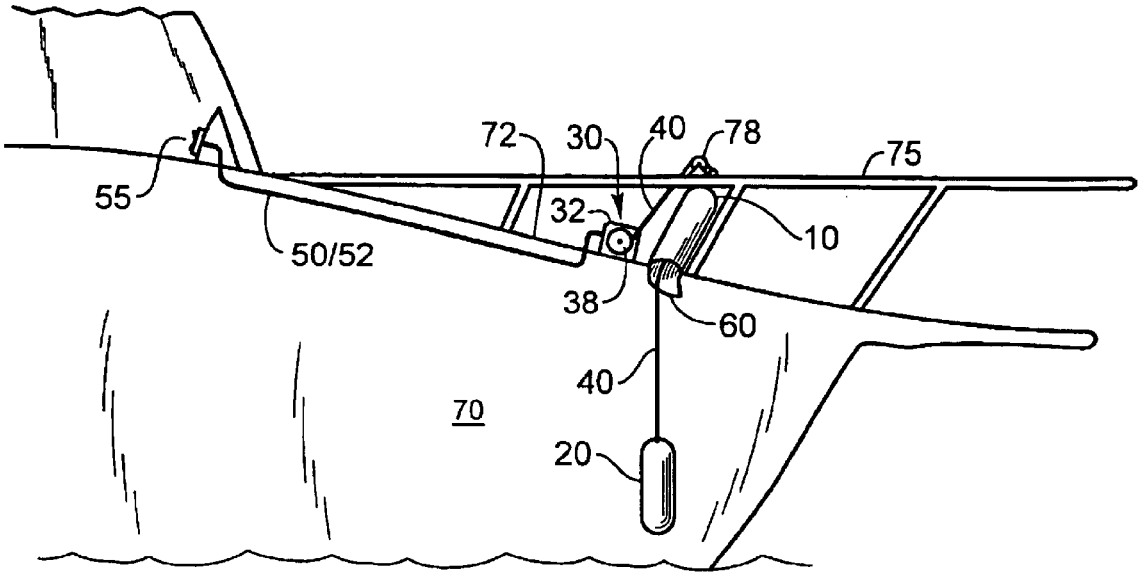
FIG. 2 is a side view of the fender retrieval system installed on the deck of a boat.

In FIG. 2 the housing 10 is attached to railing 75 and the motor 30 in motor housing 32 is placed on the deck 72 of boat 70. The fender 20 is shown inside of housing 10. The housing has a lip 60 to guide the fender 20 inside of the housing 10 while it is being retrieved. The motor 30 has a pulley or spool 38 with a line 40 running therefrom to the fender 20 over pulley 78.

Figure 3:
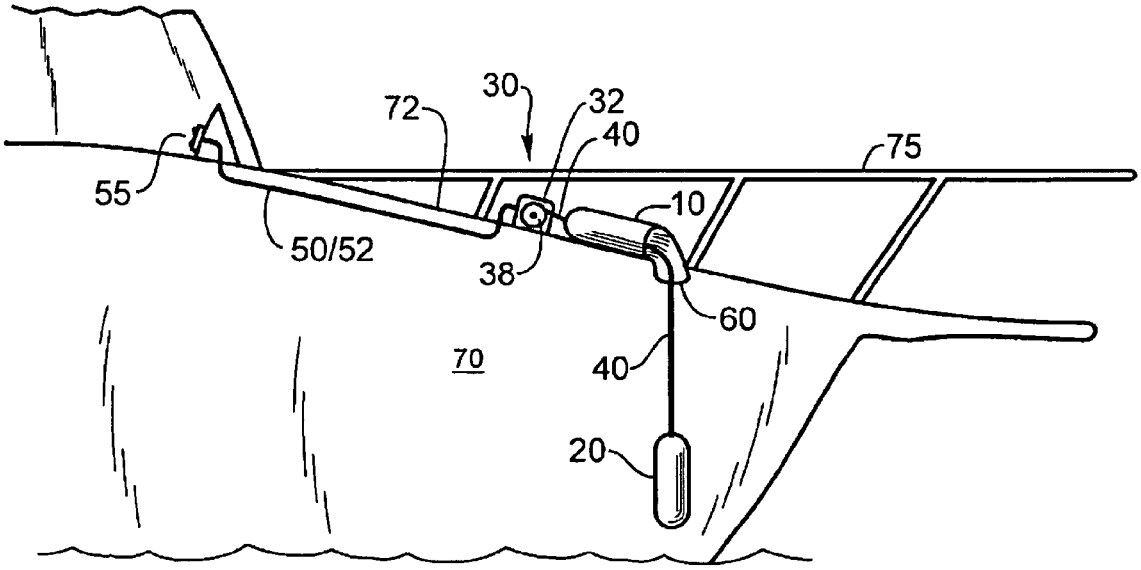
FIG. 3 is a second embodiment side view of the fender retrieval system installed on the deck of a boat.

In FIG. 3 the housing 10 is attached to the deck 72. Fender 10 enters and leaves housing 10 by way of lip 60 which guides the fender 20 back into the housing 10 when it is being retrieved. The motor 30 can be inside of the housing 10 but is show in FIG. 3 as being outside of the housing and attached to the deck 72 of boat 70.

Figure 4:
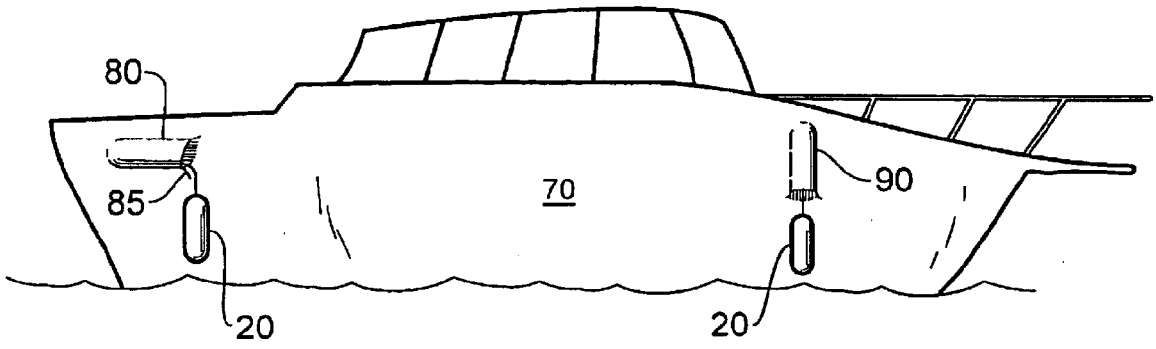
FIG. 4 is a side view of a boat with hull with a built in fender housing.

In FIG. 4 the boat 70 has hull housings 80 and 90 molded into the boat hull for the fenders 10. Hull housing 80 is substantially horizontal and has a slanted leading edge 85 acting as a guidance lip for deploying a retrieving the fender 20. There may be a spring loaded means or some other means for expelling the fender 20 from the hull housing 80 when it is horizontally mounted. The hull housing 80 may be oriented slightly downward to facilitate deployment and retrieval of the fender 20. The motor 30 can be in the hull housing 80 or inside of the boat 70. Similarly the boat 70 can have a hull housing 90, which is vertically oriented. Other orientations of the build in hull housing are possible.

In operation it is contemplated that the line 40 attached to fender 20 may be tied off on a cleat after it is extended such that forces applied to the line 40 when the fender 20 rubs against the dock or other object will be absorbed by the lines 40 connection to the cleat and not on the shaft 36 of the motor 30. It is anticipated that the fender 20 will be deployed to the desired height while approaching the dock and after docking, when it safe to move about the boat 70, the lines 40 to the fenders 20 can be tied off on a cleat.

Figure 5:
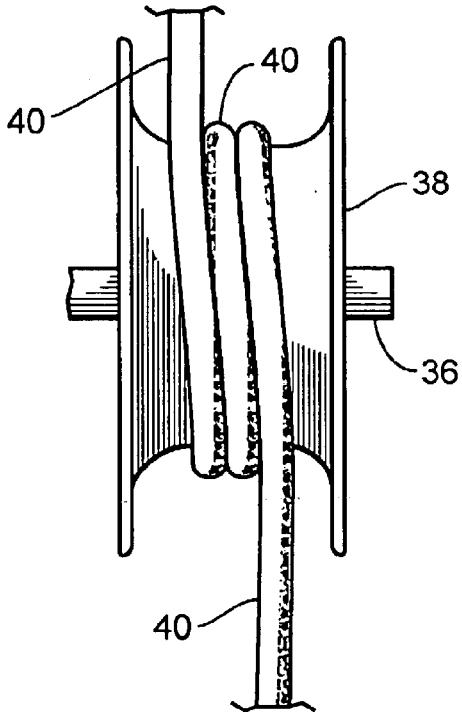
FIG. 5 is a side view of a pulley with a line wrapped around it.

In some embodiments a spool 38 such as shown in FIG. 5 will engage line 40. Line 40 may have a portion of its length stored in a line box on deck with the other end of the line 40 attached to the fender 20. In other embodiments the spool 38 will have one end of the line 40 attached to it and a portion of the length would around it for letting out or pulling in lengths of line.

The line 40 may be a nylon cord, rope, cable, wire or any other means for attaching the fender to the spool.

Although the fender retrieval system has been shown with an electric motor 30 any type of motor or actuator which can be remotely operated may be substituted for the electric motor 30.

There may be more than one fender retrieval system on the boat so that several positions on the port and starboard sides of the boat 70 can be protected. Each fender 20 would have a different switch 55 for individually positioning the fenders 20 to the correct height for that portion of the hull, which it protects. A control panel installed by the controls for the rest of the equipment run by the captain of the boat will be conveniently located for the Captain to deploy or retrieve the fenders while operating the boat.

Obviously, many modifications and variations of the present invention are possible in light of the above teachings. It is therefore to be understood that, within the scope of the appended claims, the invention may be practiced otherwise than as specifically described.

What is claimed is:

1. A fender retrieval system for a boat comprising:

a spool having a line wrapped around it for extending or retracting a length of the line, a motor for rotating the spool, a fender attached to the line, the fender being cylindrically shaped and having the line attached at one end, such that the fender is free of any other object and can move up and down along side of the boat as the line is extended and retracted by the spool, a switch for controlling the motor to deploy or retract the fender such that the fender can be placed in a desired position adjacent side of the boat when deployed, and a cylindrically shaped housing having an opening at one end for admitting the fender and having dimensions larger than the cylindrically shaped fender for sheltering the fender therein when the fender is retracted into the housing such that the fender will be secured in the housing, the line passing through at least a portion of the housing to bring the fender into the housing when the line is retracted, the housing open end being adjacent the side of the boat such that the line and the fender are deployed adjacent the side of the boat when the line is extended.

2. A fender retrieval system for a boat as in claim 1 wherein, the motor and spool are in the housing.

3. A fender retrieval system for a boat as in claim 1 wherein, the motor and spool are outside of the housing.

4. A fender retrieval system for a boat as in claim 1 wherein, the housing has a lip to guide the fender into the housing when the fender is being retracted into the housing.

5. A fender retrieval system for a boat as in claim 1 having, the housing attached to the boat.

6. A fender retrieval system for a boat as in claim 1 having, a boat hull with the housing integrally formed therein.

7. A fender retrieval system for a boat as in claim 6 wherein, the housing has an opening below the housing for deploying the fender downwardly.

* * * * *